US006135788A

United States Patent [19]

Wang et al.

[11] Patent Number: 6,135,788

[45] Date of Patent: Oct. 24, 2000

[54] CONNECTOR WITH BOARD FIXING MEANS ON VERTICAL STANDOFFS THEREOF

[75] Inventors: Chun-Chu Wang, Pan-Chiao; Fei-tai Lu, Tu-Chen, both of Taiwan

[73] Assignee: Hon Hai Precision Ind. Co., Ltd., Taipei Hsien, Taiwan

[21] Appl. No.: 08/798,330

[22] Filed: Feb. 10, 1997

[51] Int. Cl.[7] ..... H01R 12/00

[52] U.S. Cl. ..... 439/79

[58] Field of Search ..... 439/79, 80, 564, 439/571, 573, 541.5

[56] References Cited

U.S. PATENT DOCUMENTS

| | | | |
|---|---|---|---|
| 2,627,385 | 2/1953 | Tinnerman | 248/27.3 |
| 4,639,066 | 1/1987 | Shimamiya et al. | 439/569 |
| 4,721,473 | 1/1988 | DelGuidice et al. | 439/79 |
| 4,842,552 | 6/1989 | Frantz | 439/557 |
| 4,938,704 | 7/1990 | Fujiura | 439/95 |
| 4,943,244 | 7/1990 | Teck et al. | 439/567 |
| 5,024,607 | 6/1991 | Kachlic | 439/567 |
| 5,085,589 | 2/1992 | Kan | 439/92 |
| 5,125,853 | 6/1992 | Hashiguchi | 439/607 |
| 5,249,983 | 10/1993 | Hirai | 439/573 |
| 5,267,876 | 12/1993 | Ruppert et al. | 439/541.5 |

*Primary Examiner*—Steven L. Stephan
*Assistant Examiner*—Barr M. L. Standig

[57] ABSTRACT

A connector includes a housing (10) defining a mating opening (11) for receiving a complementary connector. A pair of increased standoffs (20, 40) are form on the bottom surface (22) wherein each defines a cavity or slot (26) for receiving a screw nut (29) therein. A retention hole (27) extends from the bottom surface (22) of the housing (10) into the cavity (26) so that a screw (61) can extend through a screw hole (62) in the PC board (60) on which the connector is seated, and the retention hole (27) into the cavity (26) to attach to the nut (29). Therefore, the connector can be fastened to the PC board (60) for strongly and efficiently resisting the bending movement resulting from the insertion/withdrawal force when mating with a complementary connector.

13 Claims, 4 Drawing Sheets

CONNECTOR WITH BOARD FIXING MEANS ON VERTICAL STANDOFFS THEREOF

BACKGROUND OF THE INVENTION

1. Field of the Invention

The invention relates to a connector and particularly to a connector having a structure to efficiently resist the bending moment due to mating with a complementary connector.

2. The Related Art

FIG. 1 shows the conventional connector having housing 1, a plurality of contacts 5, and a pair of boardlocks 7. The housing has a mating face defining an opening 2 for receiving a mating portion of the complementary connector. The bottom wall 3 forms three rows of passageways 4 for receiving the corresponding contact 5, respectively. A pair of cavities 6 are formed about the bottom wall 3 for retainably receiving such pair of boardlocks 7. U.S. Pat. Nos. 2,627,385, 4,639,066, 4,721,473, 4,842,552, 4,938,704, 4,943,244, 5,024,607 and 5,085,589 disclose the similar structure as aforementioned.

Recently, some modified connector includes a pair of standoff on the bottom for increasing the height of the mating opening 2, and thus a space can be formed below such opening for installation of another connector. In other words, a pair of stacked type connectors are formed for being adapted to receive a pair of complementary connectors in a small space.

Understandably, using the convention boardlocks in the height increased modified connector may result in an inferior structure because the insertion/withdrawal force applied to the mating opening is far from the locking claws of the boardlock, thus result in a larger bending moment and which will loosen the boardlock.

Therefore, an object of the invention is to provide a connector having board retention means closer to the mating opening so as to form a smaller bending moment when a insertion/withdrawal force is imposed thereon.

SUMMARY OF THE INVENTION

According to an aspect of the invention, a connector includes a housing defining a mating opening for receiving a complementary connector. A pair of increased standoffs are formed on the bottom surface wherein each defines a cavity or slot for receiving a screw nut therein. A retention hole extends from the bottom surface of the housing into the cavity so that a screw can extend through a screw hole in the PC board on which the connector is seated, and the retention hole into the cavity to attach to the nut. Therefore, the connector can be fastened to the PC board for strongly and efficiently resisting the bending movement resulting from the insertion/withdrawal force when mating.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
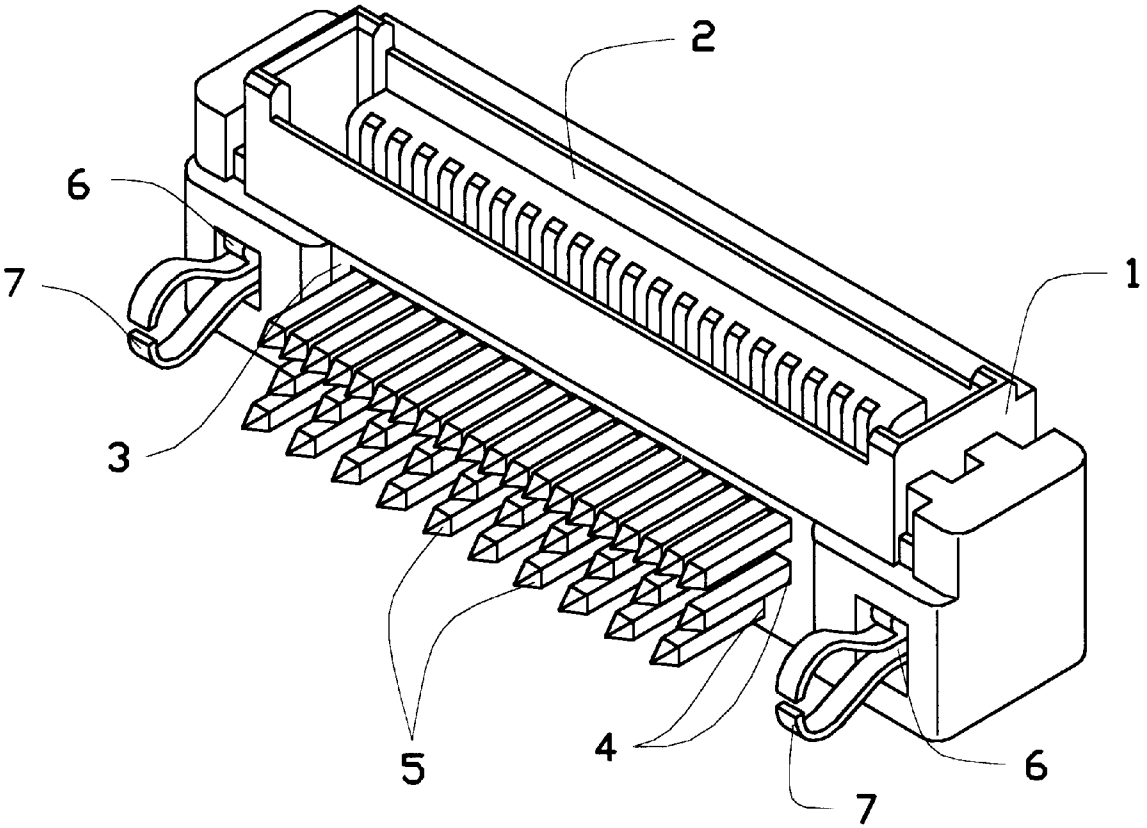
FIG.1 (PRIOR ART)
FIG. 1 is a perspective view of the prior art conventional connector.
Figure 2:
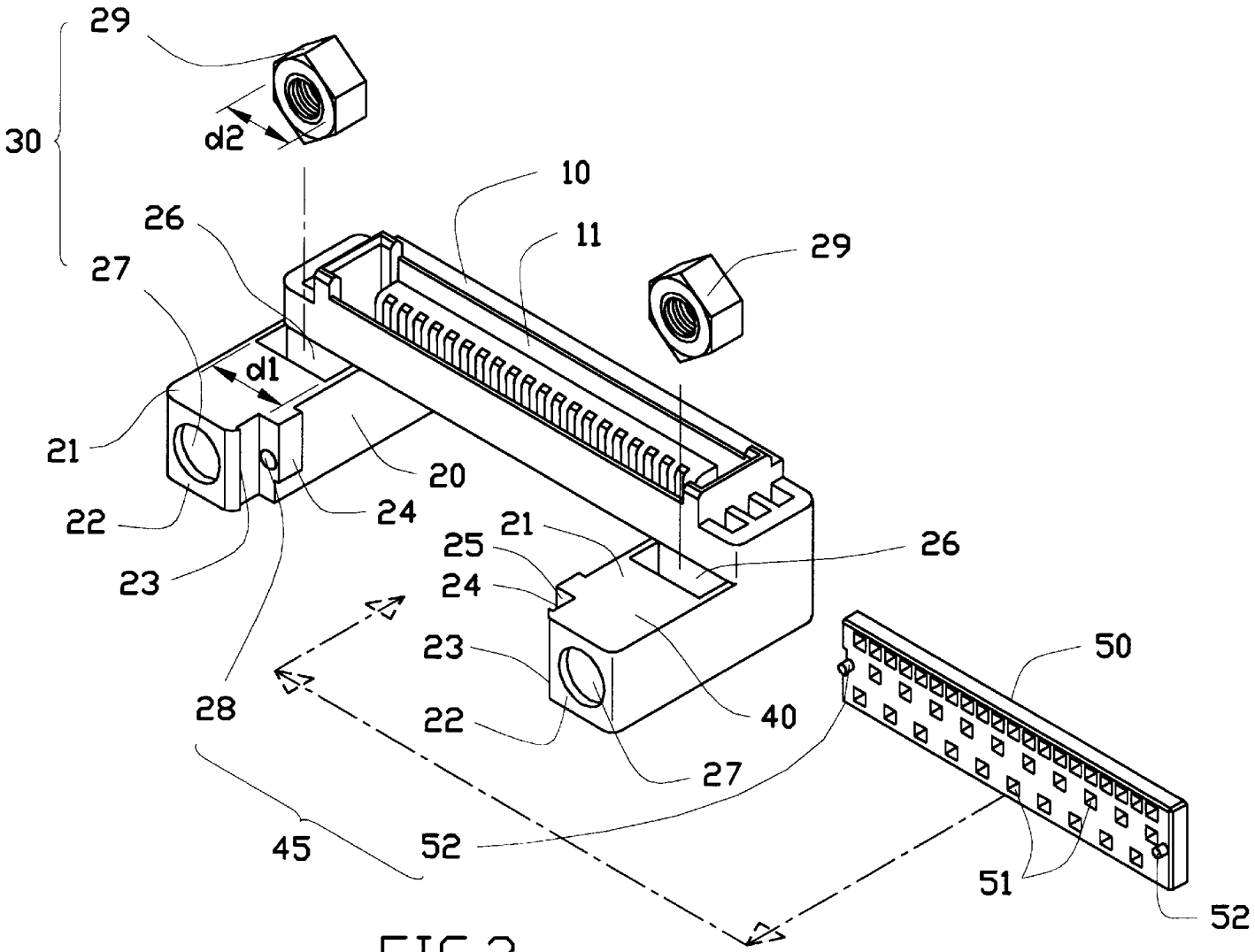
FIG. 2 is an exploded perspective view of a presently preferred embodiment of the invention.
Figure 3:
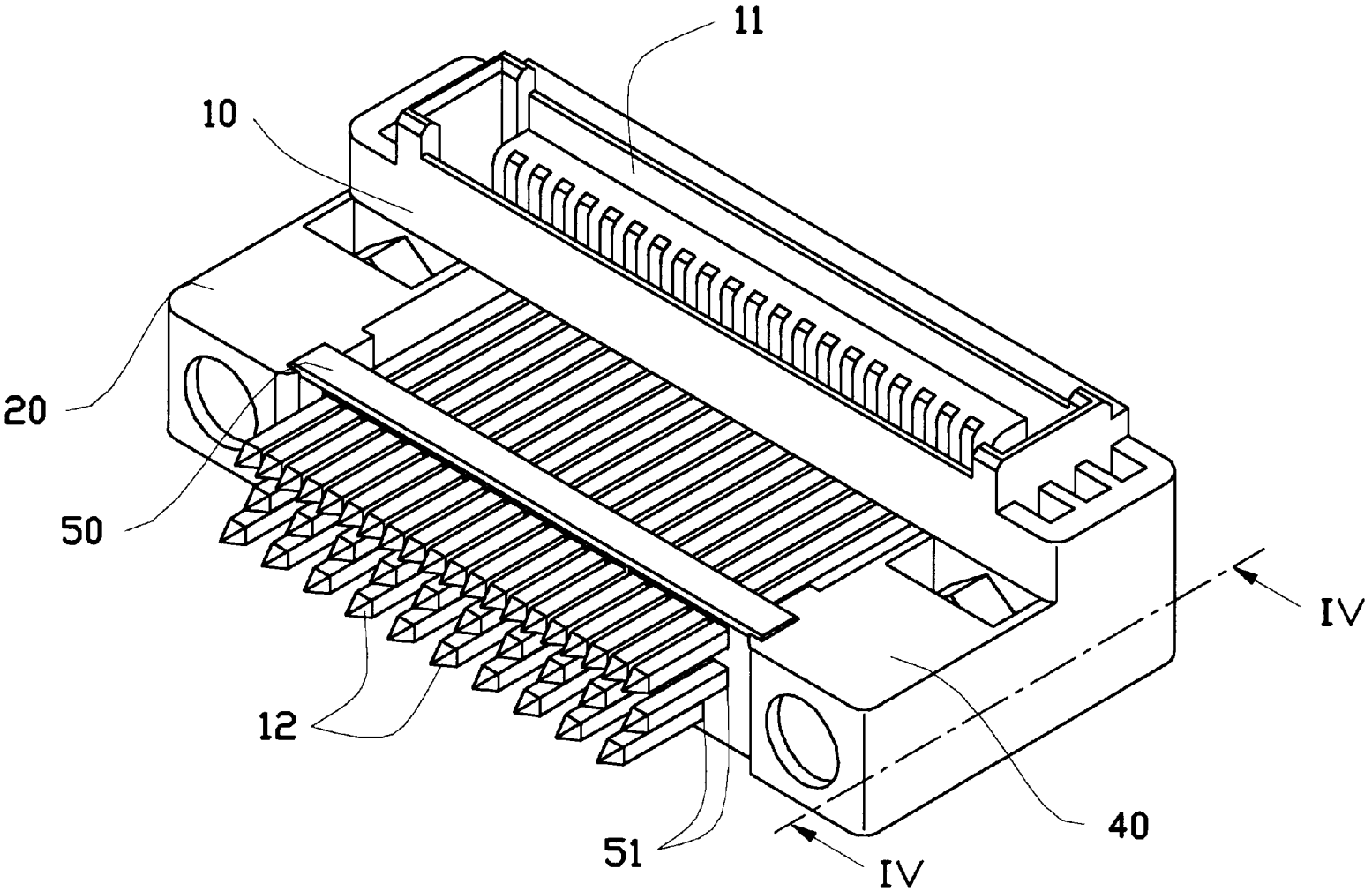
FIG. 3 is a perspective view of the assembled connector of FIG. 2.
Figure 4:
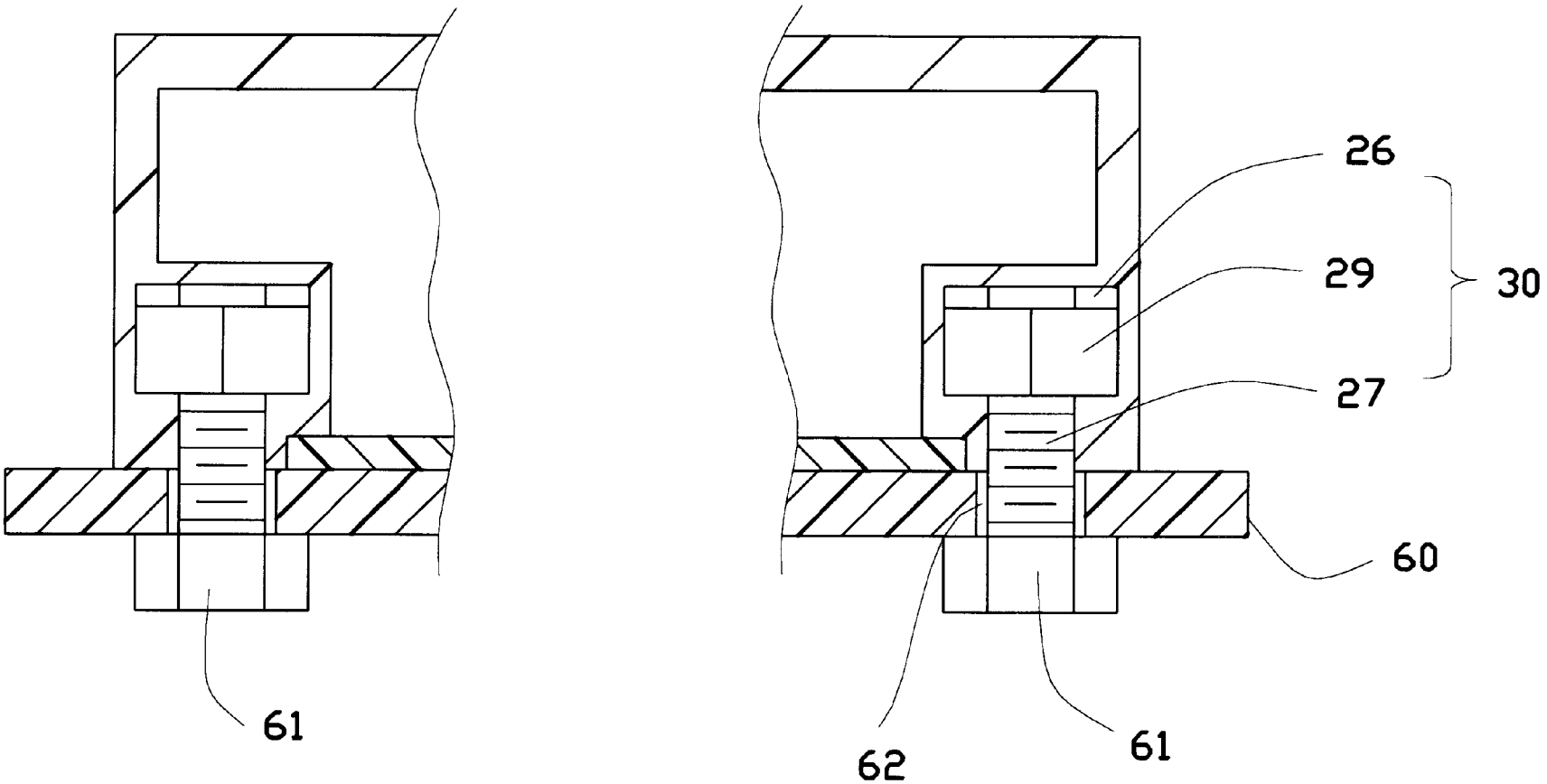
FIG. 4 is a partial cross-sectional view of the assembled connector of FIG. 3 mounted on the PC board.

It will be noted here that for a better understanding, most of like components are designated by like reference numerals throughout the various figures in the embodiments. Attention is directed to FIGS. 2–4 wherein a connector includes a housing 10, a plurality of contacts 12, a pair of increased standoffs 20, 40, a fixation device 30, an engagement device 45, and an alignment device 50.

A mating opening 11 is formed within the housing 10 for receiving therein a complementary connector (not shown) and receiving such plural contacts 12. The increased standoffs 20, 40 extend downward from two ends of the bottom of the housing 10 for providing a space below the mating opening 11 so as to be adapted to install another connector therein.

A one side closed retention slot 26 is formed in the upper portion of the standoff 20. A retention hole 27 extends upward from the bottom surface 22 into the slot 26. A tapered guiding retention portion 23 integrally extends inward from the bottom surface 22 of each standoff 20, 40 and commonly defines a space 25 with a block 24 of the housing 10 wherein such block 24 includes a hole 28. A nut 29 is snugly received within the slot 26. In this embodiment, the fixation device 30 includes the slots 26, the retention holes 27 and the nuts 29 for providing a good retention function.

The alignment device 50 includes a plurality of passages 51 for allowing tails of the contacts 12 to extend therethrough. A pair of posts 52 are formed on two ends of the alignment device 50 so that when the alignment device 50 is pressed into the space 25 from the bottom, the posts 52 are received within the holes 28, respectively, for providing reinforcement. The holes 28 and the corresponding posts 52 commonly define the engagement device 45.

FIG. 3 shows tails of the contacts 12 extend through the passages 51 of the alignment device 50 for engagement within the corresponding holes (not shown) in the PC board 60 (FIG. 4).

It is noted that in the alignment of this embodiment, one row of passages 51 is designed in a high density arrangement, and the other two rows thereof are designed in a low density arrangement so that the corresponding holes (not shown) in the PC board 60 are arranged in a properly spaced status for not jeopardizing the structure strength of the PC board 60.

FIG. 4 is a cross-sectional view of FIG. 3 along line IV—IV, showing the connector being fastened to the PC board 60 by means of the fixation device 30 wherein a screw 61 extends through a screw hole 62 in the PC board 60, the retention hole 27 and is fastened to the nut 29 in the slot 26.

Thus, because the nut 29 is positioned within the slot 26 which functions as a support point and is positioned between the mating opening 11 and the bottom surface 22, especially is closer to the mating opening 11 than to the bottom surface 22 the mating opening 11 in the vertical direction so as to reduce the length of the force arm and efficiently resist the bending movement resulting from the insertion/withdrawal of the complementary connector (not shown) with regard to the subject connector.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A connector comprising:

a housing defining a mating opening with a plurality of contacts therein; and at least a standoff extending downward from the housing wherein a fixation device is positioned on said standoff whereby a support point is formed closer to the mating opening than to a bottom surface of the at least a standoff so as to reduce an arm of force and efficiently resist a bending moment resulting from insertion or withdrawal of a complementary connector, and a distance exists between a bottom of said housing and the bottom of said at least a standoff for providing a space below the mating opening so as to be adapted to install another connector therein.

2. The connector as claimed in claim 1, wherein said fixation device comprises a lateral slot formed in an upper portion of said at least one standoff, a nut received in said lateral slot, and a vertical hole extending from a bottom surface of said at least a standoff into said slot for receiving a bolt for mating with said nut.

3. The connector as claimed in claim 1, wherein said connector further comprising an alignment device for allowing tails of said contacts extending therethrough.

4. The connector as claimed in claim 3, wherein said at least one standoff includes a pair of standoffs formed on both lengthwise ends of the housing, each comprising a tapered guiding retention portion integrally extending inward from said bottom surface of the standoff and a block integrally extending inward from a lateral surface of the standoff whereby a space is defined between said tapered guiding retention portion and said block for retaining said alignment device.

5. The connector as claimed in claim 4, wherein said alignment device includes a pair of posts formed on two ends thereof and each of said blocks of said standoffs includes a hole receiving each of said posts of the alignment device.

6. A connector comprising:

a housing defining a mating opening with a plurality of contacts therein; and at least a standoff extending downward from the housing wherein a fixation device is positioned on said standoff whereby a support point is formed at a predetermined position between the mating opening and a bottom surface of said at least a standoff in a vertical direction so as to reduce an arm of force and efficiently resist a bending moment resulting from insertion or withdrawal of a complementary connector; said fixation device comprising a lateral slot formed in an upper portion of said at least one standoff, a nut received in said lateral slot, and a vertical hole extending from the bottom surface of said at least a standoff into said slot for receiving a bolt for mating with said nut.

7. The connector as claimed in claim 6, wherein said connector further comprising an alignment device for allowing tails of said contacts extending therethrough.

8. The connector as claimed in claim 7, wherein said at least one standoff includes a pair of standoffs formed on both lengthwise ends of the housing, each comprising a tapered guiding retention portion integrally extending inward from said bottom surface of the standoff and a block integrally extending inward from a lateral surface of the standoff whereby a space is defined between said tapered guiding retention portion and said block for retaining said alignment device.

9. The connector as claimed in claim 8, wherein said alignment device includes a pair of posts formed on two ends thereof and each of said blocks of said standoffs includes a hole receiving each of said posts of the alignment device.

10. A connector comprising:

a housing defining a mating opening with a plurality of contacts therein;

at least a standoff extending downward from the housing wherein a fixation device is positioned on said standoff whereby a support point is formed at a predetermined position between the mating opening and a bottom surface of said at least a standoff in a vertical direction so as to reduce an arm of force and efficiently resist a bending moment resulting from insertion or withdrawal of a complementary connector; and an alignment device for allowing tails of said contacts extending therethrough.

11. The connector as claimed in claim 10, wherein said connector includes a pair of standoffs formed on both lengthwise ends of the housing, each comprising a tapered guiding retention portion integrally extending inward from said bottom surface of the standoff and a block integrally extending inward from a lateral surface of the standoff whereby a space is defined between said tapered guiding retention portion and said block for retaining said alignment device.

12. The connector as claimed in claim 11, wherein said alignment device includes a pair of posts formed on two ends thereof and each of said blocks of said standoffs includes a hole receiving each of said posts of the alignment device.

13. A connector comprising:

a housing defining a mating opening with a plurality of contacts therein; and at least a standoff integrally formed with and extending downward from the housing wherein a fixation device is positioned on said standoff whereby a support point is formed at a predetermined position between the mating opening and a bottom surface of said at least a standoff in a vertical direction so as to reduce an arm of force and efficiently resist a bending moment resulting from insertion or withdrawal of a complementary connector.

* * * * *